US011236464B1

(12) United States Patent
Laney

(10) Patent No.: US 11,236,464 B1
(45) Date of Patent: Feb. 1, 2022

(54) OZONE MIST FABRIC FINISHING

(71) Applicant: Levi Strauss & Co., San Francisco, CA (US)

(72) Inventor: Debra Laney, Tularosa, NM (US)

(73) Assignee: Levi Strauss & Co., San Francisco, CA (US)

( * ) Notice: Subject to any disclaimer, the term of this patent is extended or adjusted under 35 U.S.C. 154(b) by 0 days.

(21) Appl. No.: 14/527,684

(22) Filed: Oct. 29, 2014

Related U.S. Application Data

(60) Provisional application No. 61/899,104, filed on Nov. 1, 2013.

(51) Int. Cl.

| | |
|---|---|
| ***A41D 1/00*** | (2018.01) |
| ***A41D 1/06*** | (2006.01) |
| ***D06L 4/00*** | (2017.01) |
| ***D06L 4/18*** | (2017.01) |
| ***D06L 4/27*** | (2017.01) |
| ***D06L 4/29*** | (2017.01) |
| ***D06L 3/04*** | (2006.01) |

(52) U.S. Cl.
CPC ..... *D06L 3/04* (2013.01); *A41D 1/00* (2013.01); *A41D 1/06* (2013.01); *D06L 4/00* (2017.01); *D06L 4/18* (2017.01); *D06L 4/27* (2017.01); *D06L 4/29* (2017.01)

(58) Field of Classification Search
CPC ..... D06L 3/04; D06L 4/00; D06L 4/18; D06L 4/27; D06L 4/29; A41D 1/00; A41D 1/06
See application file for complete search history.

(56) References Cited

U.S. PATENT DOCUMENTS

| | | | | |
|---|---|---|---|---|
| 2004/0261194 | A1* | 12/2004 | Price | D06F 35/006 8/137 |
| 2005/0115004 | A1* | 6/2005 | Tashiro | D06B 11/0096 8/102 |
| 2011/0083282 | A1* | 4/2011 | Myung | D06P 5/153 8/111 |
| 2014/0068871 | A1* | 3/2014 | Youn | D06L 4/50 8/111 |

* cited by examiner

*Primary Examiner* — Amina S Khan
(74) *Attorney, Agent, or Firm* — Aka Chan LLP

(57) ABSTRACT

A mist of water and air and ozone gas is used in the finishing of fabrics of jeans and other apparel to achieve a faded, worn, or washed appearance and finish. Jeans or other apparel items are processed in a chamber of a finishing machine. Water and air mist that includes drops of liquid water are sprayed into the chamber. Ozone is separately introduced into the chamber. After processing, the jeans or other apparel will have a stonewashed or acid-washed appearance.

20 Claims, 7 Drawing Sheets

OZONE MIST FABRIC FINISHING

CROSS-REFERENCE TO RELATED APPLICATIONS

This patent application claims the benefit of U.S. patent application 61/899,104, filed Nov. 1, 2013, which is incorporated by reference along with all other references cited in this application.

BACKGROUND OF THE INVENTION

The present invention generally relates to a system and method of fabric finishing, and more specifically to finishing jeans and other pants to have a faded, worn, distressed, or washed appearance and feel.

In 1853, during the California Gold Rush, Levi Strauss, a 24-year-old German immigrant, left New York for San Francisco with a small supply of dry goods with the intention of opening a branch of his brother's New York dry goods business. Shortly after arriving in San Francisco, Mr. Strauss realized that the miners and prospectors (called the "forty niners") needed pants strong enough to last through the hard working conditions they endured. So, Mr. Strauss developed the now familiar jeans that he sold to the miners. The company he founded, Levi Strauss & Co., still sells jeans and is the most widely known jeans brand in the world. Levi's is a trademark of Levi Strauss & Co.

Jeans at the time of the Gold Rush were used as work clothes and fashion was not a concern. Since the time of the Gold Rush, however, jeans have evolved to be fashionably worn everyday by men and women, showing up on billboards, television commercials, and fashion runways. Fashion is one of the largest consumer industries in the U.S. and around the world. Jeans and related apparel are a significant segment of the fashion industry.

As fashion, people care about the appearance and feel of their jeans. While the original blue jeans had an unfaded indigo-dyed appearance and stiff denim or canvas feel, a modern trend is to finish jeans to have a faded, worn, or washed appearance and a softer and more flexible feel.

Some techniques for finishing jeans include stonewashing and acid washing. The finishing techniques typically require relatively large amounts of resources including water, chemicals, and stone, especially when used in mass production. The spent water, chemicals, stone, and other material end up as waste that needs to be disposed of Generally, substantial resources are used in the finishing of garments such as jeans, which includes the cost of the resources and material, disposal of the waste, and impact on the environment.

Despite the widespread success of existing finishing approaches, there is a need for improved techniques for finishing jeans and other apparel to reduce the resources and material used, reduce waste, and reduce the impact on the environment. And improved techniques can improve the finishing of jeans and other apparel compared to that previously available.

BRIEF SUMMARY OF THE INVENTION

A mist of water and air and ozone gas is used in the finishing of fabrics of jeans and other apparel to achieve a faded, worn, or washed appearance and finish. Jeans or other apparel items are processed in a chamber of a finishing machine. Water and air mist that includes drops of liquid water are sprayed into the chamber. Ozone is separately introduced into the chamber. After processing, the jeans or other apparel will have a stonewashed or acid-washed appearance.

In one implementation, an article of apparel that includes jeans have a finished pattern from a finishing process that includes: receiving the jeans in a drum of a finishing system; spraying a water and air mist into the drum at a first position on the drum; rotating the drum; wetting the jeans with water droplets in the water and air mist in the finished pattern; spraying ozone gas into the drum from a second position on the drum, wherein the first position is different from the second position; absorbing the ozone by the water droplets; bleaching a dye of the jeans at locations where the water droplets contact the jeans to effect the finish or coloration pattern; and evacuating the ozone from the drum.

In various implementations, the finished pattern is a stonewashed pattern. The first position and the second position are ninety degrees apart. The first position is in a door of the drum and the second position is at a top of the drum. The spraying the water and air mist includes spraying a metered amount of the water and air mist, and spraying the ozone includes spraying a metered amount of ozone.

The water and air mist includes water droplets. The water and air mist does not include steam (or gaseous water or water vapor). Spraying the water and air mist includes spraying the water and air mist at a temperature below which water droplets in the water and air mist turn to steam. The spraying the water and air mist includes spraying the water and air mist at ambient temperature.

At least a portion of water droplets in the water and air mist have a size range of 200 microns to 250 microns. At least a portion of water droplets in the water and air mist have a size of 180 microns to effect a swirling of the water droplets and the finished pattern includes a shadow pattern based on the swirling of the water droplets.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
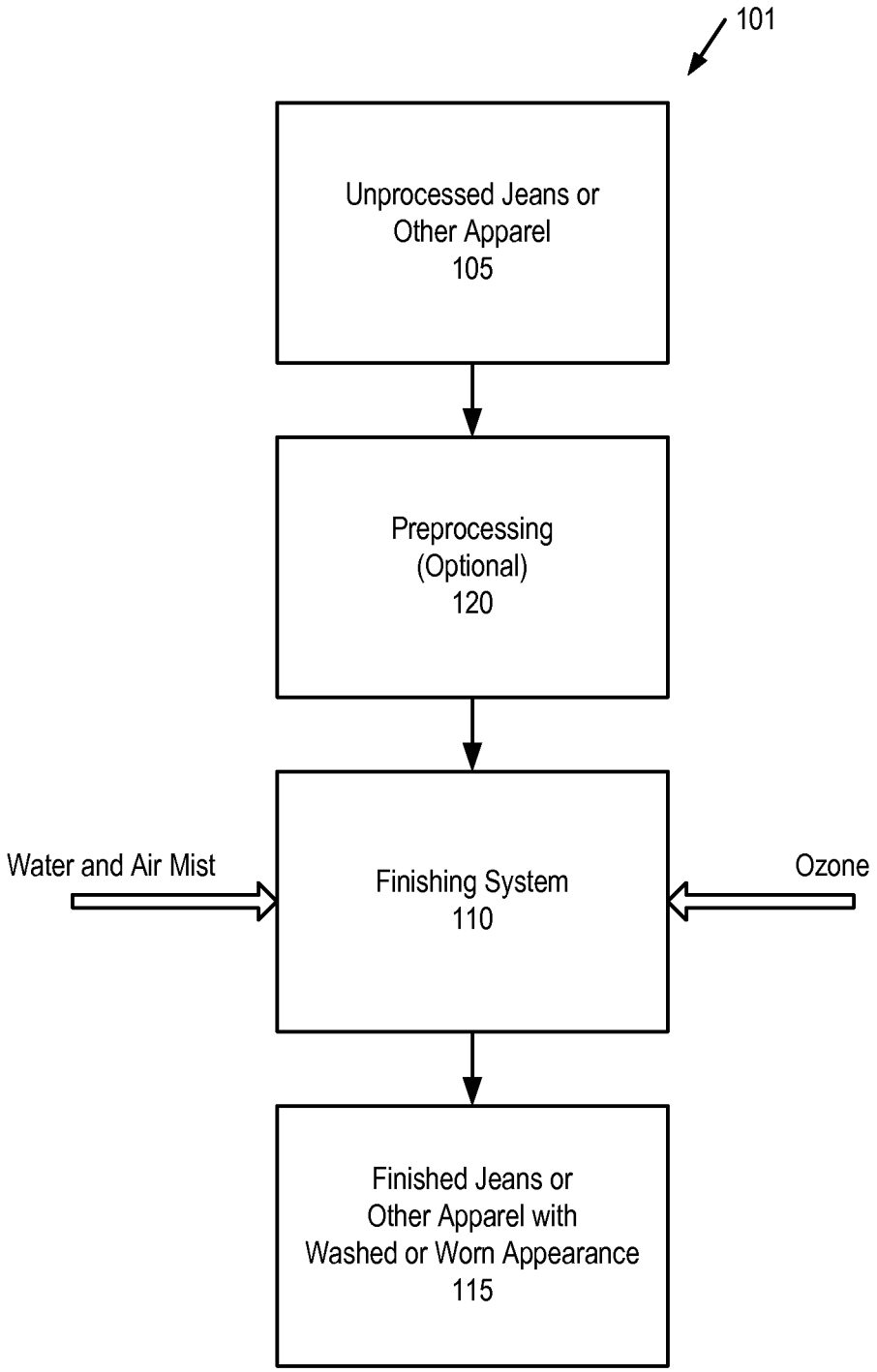
FIG. 1 shows a finishing process.

FIG. 1 shows a finishing process 101 for processing jeans or other apparel 105 to have a worn, faded, or washed appearance. Unprocessed jeans 105 are provided to a finishing system 110, which processes the unprocessed jeans and alters the finish of the unprocessed jeans. Finish as referred to herein may refer to the color, the color pattern, the texture, and the like of the jeans. Output from finishing system 110 are finished jeans or other finished apparel 115. Processed jeans 115 will have a worn, faded, or washed appearance. In a specific implementation, processed jeans 115 will have a stonewashed or acid-washed appearance.

As input for the processing, finishing system 105 uses a combination of water and air in spray or mist form and ozone gas. More details of the processing are discussed below. Although not required, unprocessed jeans 105 can be preprocessed 120 before the unprocessed jeans are placed into the finishing system. For example, the unprocessed jeans can be preprocessed by sanding (e.g., using sandpaper) certain locations or regions of the jeans, so that these locations or regions of the jeans will exhibit a more worn or faded look after finishing by the finishing system. Preprocessing is optional. In some implementations, there may be one or more additional postprocessing steps (not shown), such as wash steps, are performed on the finished jeans.

Stonewashed jeans and other apparel (e.g., shorts, jackets, vests, and shirts) have a faded, worn appearance. Traditionally, this finishing is accomplished by washing the jeans with pumice in a rotating drum or also by using chemicals to create the appearance. Some concerns include that the use pumice and chemicals for stonewashing has relatively high cost and causes harm to the environment. In comparison, the finishing process described in this patent application can achieve the stonewashed appearance without the costs and harm to the environment associated with existing techniques.

The fabric or material of the jeans or other apparel can be cotton or a cotton blend. In implementations, the fabric is a woven or knit fabric (e.g., denim, twill, or corduroy), made of a cotton blend fabric (e.g., cotton blended with Lycra, polyester, acrylic, nylon, acetate, viscose, and triacetate). In other implementations, the fabric can be any natural fiber textile (e.g., wool or silk), synthetic fabric or a combination of these.

For example, the material can be a denim material including cotton blended with a fiber other than a cotton fiber. The cotton blended material typically has greater stretch than a pure cotton material, without the blended material. In a specific implementation, the fiber includes spandex; other implementations can use polyester for stretch.

In a specific implementation, the finishing system works in conjunction with a shaped fit sizing system such as Levi's Curve ID or liquid stretch body shaping system such as Levi's Revel, or a combination of these. Revel and Curve ID are trademarks of Levi Strauss & Co. A more detailed discussion of the Curve ID system is in U.S. application 61/391,579 and Ser. No. 12/917,887 (issued as U.S. Pat. No. 8,307,560). A more detailed discussion of the Revel system is in U.S. patent application 61/699,286, Ser. Nos. 13/801,374, and 14/023,393. These applications are incorporated by reference along with all other references cited in this application.

Figure 2:
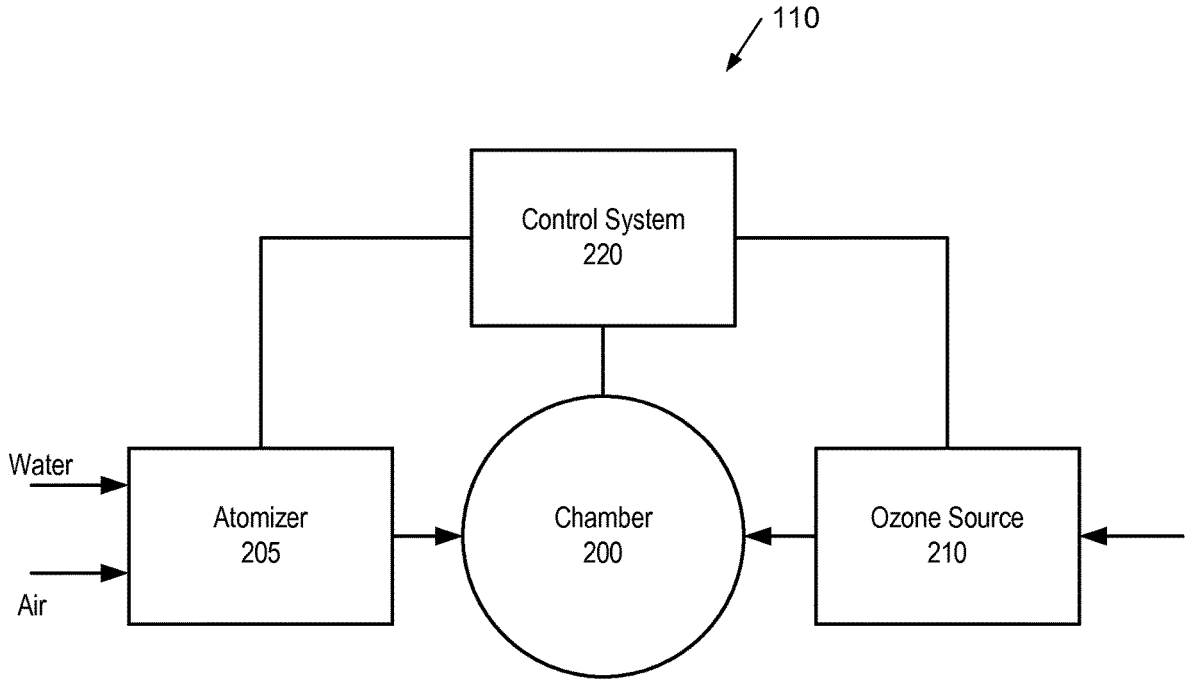
FIG. 2 shows a block diagram of a finishing system.

FIG. 2 shows a block diagram of finishing system 110. The finishing system has a chamber 200, which is connected to an atomizer 205 and ozone source 210. A control system 220 is connected to the chamber, atomizer, and ozone source to control operation of the finishing system.

The chamber holds the unprocessed jeans or other apparel for processing. In a specific implementation, the chamber is a drum, such as a drum that can rotate, similar to a commercial washing machine drum. Like a washing machine drum, the drum can include paddles on the side which help push the jeans in the direction of rotation. In other implementations, the chamber can be another compartment to hold the jeans. Typically, the chamber is capable of agitating the jeans during the processing.

The atomizer mixes water and air and outputs a mist of water and air that is injected into the chamber. The atomizer can be an air gun sprayer, such as used on a paint gun sprayer, or other device (e.g., nozzle or venture) that creates droplets of liquid water and air. In an implementation, air provided from an air line is pressured to aid in the formation of the mist by the atomizer. In other implementations, the atomizer can include a pressure source (e.g., a vibrating membrane) for pressuring the water, air, or both for forming the mist.

Typically the size of the liquid water droplets will have a distribution of sizes, such as from about 100 to about 180 microns in diameter. In other implementation, the droplet size can range from about 180 microns to about 400 microns.

The ozone source generates ozone gas that is injected into the chamber. In an implementation, the mist inlet and the ozone inlet for introducing mist and ozone are different inlets or ports to the chamber. For example, mist and ozone can be introduced at different locations or positions of the chamber or drum.

Figure 3:
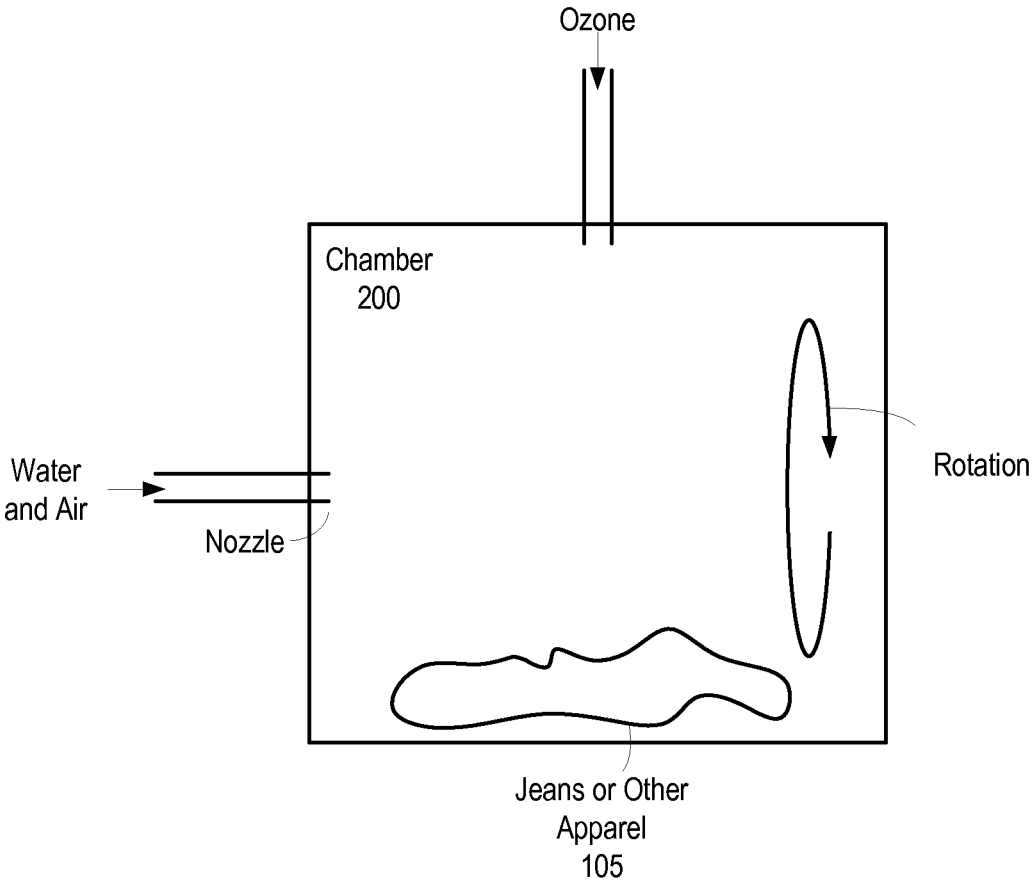
FIG. 3 is a cross-sectional view of a chamber for the finishing system.

FIG. 3 is a cross-sectional view of chamber 200 of a specific implementation of finishing system 110. Mist and ozone are introduced at different locations of chamber 200. For example, the mist and ozone can be introduced into the drum at perpendicular or traverse to each other. The ozone is introduced into the drum from a top portion of the chamber while the mist is introduced at a side of the chamber. The side of the chamber can be a door of the drum from which unprocessed jeans can be placed into the drum. The chamber can be a drum that rotates (e.g., clockwise or counterclockwise direction, or a combination of these).

Although a single port is shown for ozone, ozone can be introduced via multiple ports. Similarly, although a single nozzle is shown for water and air, there may be multiple nozzles. For example, in an implementation, finishing system 110 includes a first atomizer nozzle on a front side (e.g., at a front door) of chamber 200 and a second atomizer at a back side or opposite side of the chamber. Also, there can be one or more inlets that introduce ozone where the inlets may be located at various positions in the chamber.

The chamber is constructed so that ozone, which is a bleaching agent, does not leak from the chamber during operation. For example, the drum and door have seals that inhibit ozone from escaping from the drum with the door closed. Further these seals are ozone resistant so that do not degrade due to exposure to ozone. Sealing the ozone in the drum prevents people who work with the finishing system from coming into contact with the ozone. Subsequent all finishing processes 101 being performed, the ozone is evacuated from finishing system 110 and evacuated from the room in which the finishing system is located to further prevent people who work with the finishing system from coming into contact with the ozone.

Returning to FIG. 2, finishing system 105 includes a control system 220 that controls one or more of chamber or drum 200, atomizer 205, and ozone source 210. For example, control system 220, can control the rotation rate of the drum, various start times and stop times for starting and stopping rotation the drum during a finishing process. More specifically, control system 220 can control a set of drum motors that rotate the drum. Control system 200 can also control atomizer 205. Specifically, control system 200 can control time points (e.g., time points in a coloration process) at which atomizer 205 introduces mist into the drum, control a duration of time in which mist is introduced into the drum, and control an amount of mist that is introduced into the drum during a given time. An amount of mist may include a regulated amount of water, a regulated amount of air, or both. Control system 200 can also control ozone source 210. Specifically, control system 200 can control the time points at which ozone source 210 introduces ozone into drum 200, control the duration of time in which ozone is introduced into the drum, and control the amount of ozone that is introduced.

Figure 4:
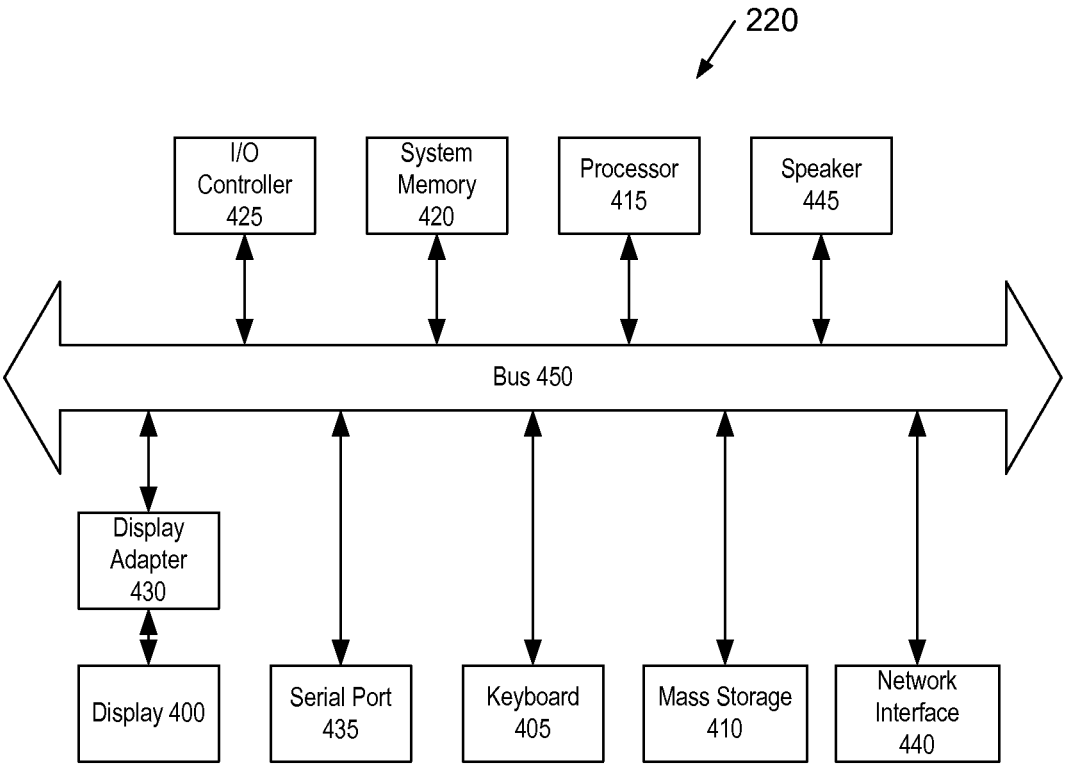
FIG. 4 shows a control system of the finishing system.

FIG. 4 shows details of a control system 220. This control system executes software or firmware to control the finishing system. In various implementations, the control system can be a computer, laptop computer, electronic controller, smartphone, tablet, or other electronic control. In the implementation of control system 220 shown in FIG. 4, the control system includes a display 400, a keyboard or other user input device 405, and a mass storage devices 410. Control system 220 further includes subsystems such as a central processor 415, a system memory 420 (e.g., Flash, EEPROM, EPROM, PROM, RAM, or the like), an input/output (I/O) controller 425, a display adapter 430, a serial or universal serial bus (USB) port 435, a network interface 440, and a speaker 445. The invention may also be used with control systems with additional or fewer subsystems. For example, a control system could include more than one processor 435 (i.e., a multiprocessor system) or a system may include a cache memory.

Arrows such as 450 represent the system bus architecture of control system 220. However, these arrows are illustrative of any interconnection scheme serving to link the subsystems. For example, speaker 445 could be connected to the other subsystems through a port or have an internal direct connection to central processor 415. The central processor may include multiple processors or a multicore processor, which may permit parallel processing of information. Control system 220 shown in FIG. 4 is one example of a control system suitable for use with the present invention. Other configurations of subsystems suitable for use with the present invention will be readily apparent to one of ordinary skill in the art.

Computer software products may be written in any of various suitable programming languages, such as C, C++, C#, Pascal, Fortran, Perl, Matlab (from MathWorks, www.mathworks.com), SAS, SPSS, JavaScript, AJAX, Java, Erlang, and Ruby on Rails. The computer software product may be an independent application with data input and data display modules. Alternatively, the computer software products may be classes that may be instantiated as distributed objects. The computer software products may also be component software such as Java Beans (from Sun Microsystems) or Enterprise Java Beans (EJB from Sun Microsystems).

An operating system for the system may be one of the Microsoft Windows® family of systems (e.g., Windows 95, 98, Me, Windows NT, Windows 2000, Windows XP, Windows XP x64 Edition, Windows Vista, Windows 7, Windows 8, Windows CE, Windows Mobile, Windows RT), Symbian OS, Tizen, Linux, HP-UX, UNIX, Sun OS, Solaris, Mac OS X, Apple iOS, Android, Alpha OS, AIX, IRIX32, or IRIX64. Other operating systems may be used. Microsoft Windows is a trademark of Microsoft Corporation.

Furthermore, control system 220 may be connected to a network via network interface 440 and may interface to other computers and control systems using this network. The network may be an intranet, internet, or the Internet, among others. The network may be a wired network (e.g., using copper), telephone network, packet network, an optical network (e.g., using optical fiber), or a wireless network, or any combination of these. For example, data and other information may be passed between the control system and components (or steps) of a system of the invention using a wireless network using a protocol such as Wi-Fi (IEEE standards 802.11, 802.11a, 802.11b, 802.11e, 802.11g, 802.11i, 802.11n, 802.11ac, and 802.11ad, just to name a few examples), near field communication (NFC), radio-frequency identification (RFID), mobile or cellular wireless (e.g., 2G, 3G, 4G, 3GPP LTE, WiMAX, LTE, LTE Advanced, Flash-OFDM, HIPERMAN, iBurst, EDGE Evolution, UMTS, UMTS-TDD, 1×RDD, and EV-DO). For example, signals from the control system may be transferred, at least in part, wirelessly to components or other computers.

In an implementation with a web browser executing on control system 220, a user accesses a system on the World Wide Web (WWW) through a network such as the Internet. The web browser is used to download web pages or other content in various formats including HTML, XML, text, PDF, and postscript, and may be used to upload information to other parts of the system. The web browser may use uniform resource identifiers (URLs) to identify resources on the web and hypertext transfer protocol (HTTP) in transferring files on the web.

In other implementations, a user accesses control system 220 through either or both of native and nonnative applications. Native applications are locally installed on the control system and are specific to the operating system or one or more hardware devices of the control system. These applications (which are sometimes also referred to as "apps") can be updated (e.g., periodically) via a direct internet upgrade patching mechanism or through an applications source.

The control system can run platform-independent, nonnative applications. For example, a client can access the control system through a web application from one or more servers using a network connection. For example, a web application can be downloaded from an application server over the Internet by a web browser to the control system. Nonnative applications can also be obtained from other sources, such as a disk.

The control system controls operation finishing system. Some flows for finishing jeans or other apparel follows. Some specific flows are presented in this patent, but it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data.

A first flow implementation includes:

1. Dry jeans or other apparel are placed in the chamber for processing.

2. Water and air are sprayed through a paint gun nozzle into the ozone machine chamber or drum.

3. Ozone is injected into the machine at the same time when the water and air are injected.

4. The machine is rotating while the water and air and ozone are rotating.

This flow method provides a stonewash effect on the surface of the garments.

A second flow implementation includes:

1. Dry jeans or other apparel are placed in the chamber for processing.

2. Water and air are sprayed through the nozzle while the machine is static. The drum is not rotating.

3. Once the amount of water and time is completed, the water spray is turned off 4. The machine begins to rotate and ozone is injected into the machine.

This flow gives uneven coverage that can appear to be almost acid wash or other effects.

A third flow implementation includes:

1. Dry jeans or other apparel are placed in the chamber for processing.

2. Water and air sprayed through the nozzle while the machine is running Ozone is off.

3. After amount of water desired has been sprayed, the ozone is turned on.

This flow gives flatter appearance. For a flatter appearance, the high intensity and low intensity regions on the fabric will not have as great of a range.

A fourth flow implementation includes:

1. Spraying a localized abrasion region with water (with a spray gun) before the ozone mist process, such as one of the three flows described above.

2. Steps as in above three flows, but jeans or other apparel are not completely dry. The apparel will be wet where sprayed with water.

This enhances the effect of the dry process compared to processing using localized abrasion or chemical enhancement. Specifically, typical processes include spraying the hand-sanded or laser local abrasion with a potassium permanganate solution, or another similar chemical. Then this chemical is neutralize in a wash step using sodium bisulfite, HAS, or similar other chemistry. With an ozone mist process, no additional neutralization is needed beyond the rinses needed to clear the ozone.

In some specific implementations of the flows, garments are with a long cycle hot rinse, either with or without stones, depending on the effect desired. There are no chemicals, just water or water with stones. Some garments are processed at a wet pick up (WPU) of about 40-60 percent before mist to achieve a bleached look with no other chemicals.

Figure 5:
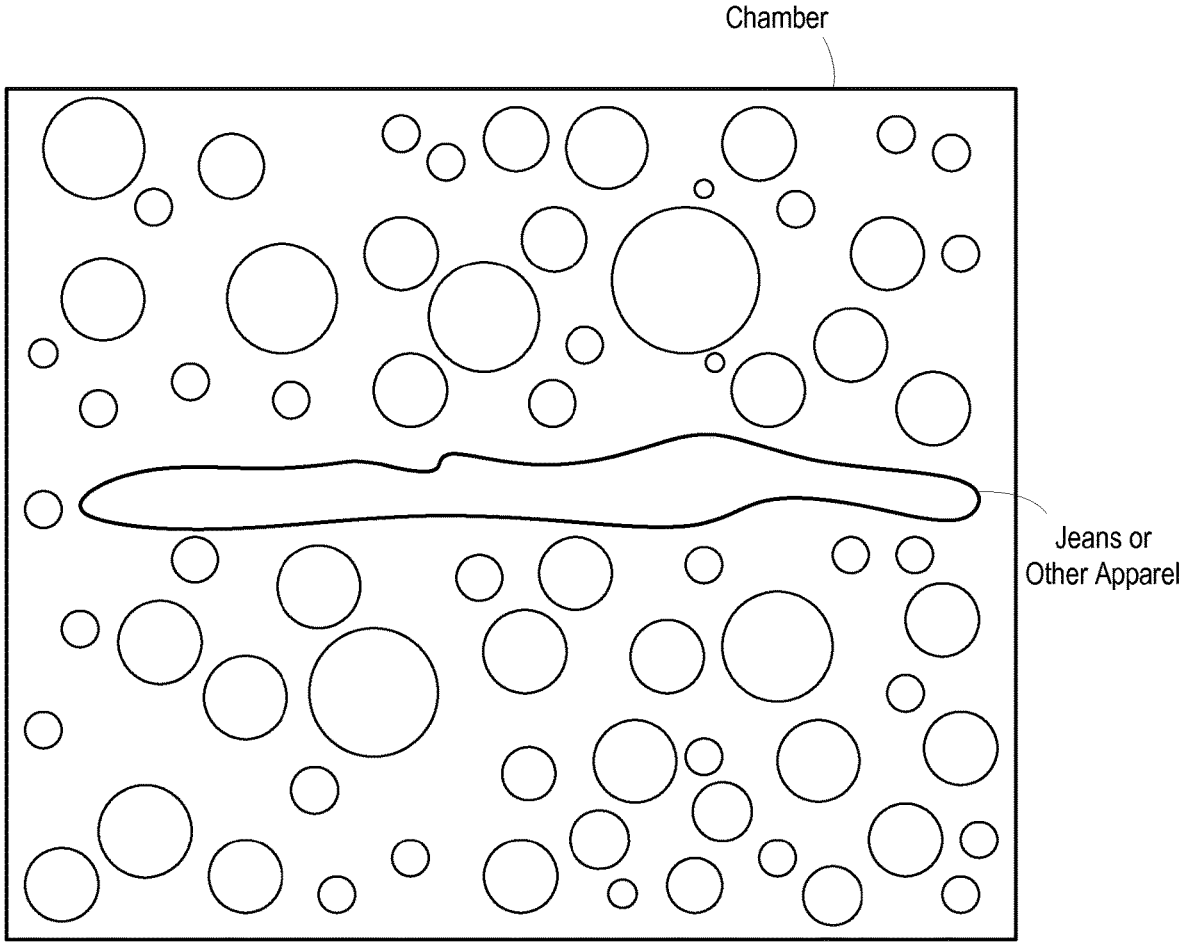
FIG. 5 shows an environment of a chamber, including a mist of water and air and ozone and jeans or other apparel, during processing.

FIG. 5 shows a chamber 200 with jeans or other apparel with water and air mist and ozone during processing. The droplets are represented by circles. There are various circle sizes to represent different droplet sizes, which are in a distribution of water droplets output from a spray gun or atomizer nozzle. Ozone is also introduced into the chamber. Air and ozone will be in the space between the water droplets. The jeans or other apparel are agitated in this environment.

In an implementation, the liquid water droplets are relatively small, such as less than 180 microns, so that air currents in the chamber can move droplets within the chamber in a wave-like fashion. So, while the jeans are agitated, such as by rotation of the drum, the water droplets and ozone swirl around the jeans. This effect on the water droplet and ozone mixture affects the finishing of the fabric.

Figure 6:
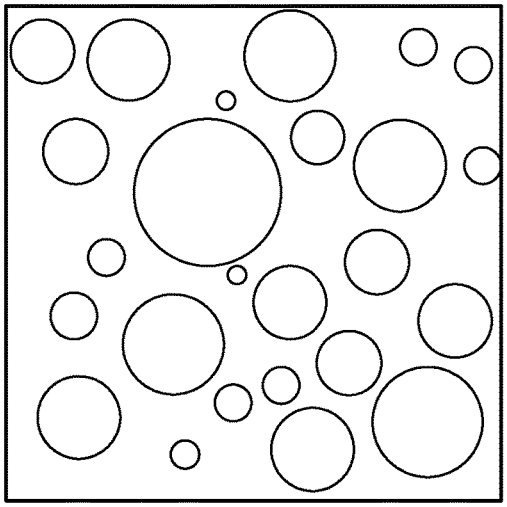
FIG. 6 shows a magnified view of the fabric of jeans or other apparel that has been processed using the finishing system.

FIG. 6 shows a magnified view of the fabric of jeans or other apparel that has been processed. There are circles indicating lighter regions, which can be referred to a lower intensity color regions. These circles are representative of the regions that been bleached or oxidized by the ozone. The spaces between the circles are darker regions, can be referred to a higher intensity color regions. These spaces are representative of the regions that been not bleached or bleached less by the ozone.

During processing in the chamber, the fabric areas where water was absorbed will undergo bleaching by the ozone. Fabric areas where water was not absorbed or absorbed less, bleaching will not occur or occur less. FIG. 6 is a result of finishing shown in a chamber of FIG. 5. The mist and ozone environment in the chamber help create a shadowing effect on the fabric. The result is the fabric will have a coloration pattern having a washed or stonewashed appearance.

Colors in most dye and pigments such indigo are produced by molecules which contain chromophores. An oxidizing agent such as ozone works by breaking the chemical bonds that make up the chromophore. This changes the molecule into a different substance that either does not contain a chromophore, or contains a chromophore that does not absorb visible light. A reducing agent such as sodium dithionite (also know as sodium hydrosulfite) works by converting double bonds in the chromophore into single bonds. This eliminates the ability of the chromophore to absorb visible light.

In the process for a specific implementation, the mist surrounds the jeans and wets the jeans. The drum may be rotated while the water is first introduced into the drum to wet the jeans, and the ozone may be introduced after the mist is introduced or may be introduced contemporaneously with the mist.

The ozone in the water droplets may bleach the dye of the jeans at the locations where the water droplets land on the jeans. The ozone can also bleach the jeans where the ozone contacts the jeans without being absorbed in a water droplet. The ozone in the water droplets tends to bleach the dye more effectively providing a washed (e.g., a stonewashed) finish. The ozone that contacts the jeans in gaseous form (not in a water droplet) tends to provide a relatively even bleaching effect (lightening the dye generally uniformly).

The wet pick up (WPU) percentage of the fabric treated with the mist can vary over a relatively large range, such as about 30 percent to about 90 percent, (e.g., 30 percent, 30 percent, 35 percent, 40 percent, 50 percent, 55 percent, 60 percent, 65 percent, or 70 percent, or the like). The various WPU percentages can affect the amount of bleaching performed by the ozone so that the fabric can have a relatively light stonewashed finish, a medium stonewashed finish, or a relatively extensive stonewashed finish. The amount of mist applied per piece of apparel tends to increase the WPU percentage and thereby increase the amount of bleaching for a given amount of ozone used.

The mist includes water particles that have a variety of droplet sizes. In one implementation, the droplet sizes may range from about 200 microns to about 250 microns. In some implementations the water droplets in the mist can be larger the 250 microns, but are generally smaller than a size at which the water droplets can contact the jeans and form a splatter pattern on the jeans. Water droplets of these sizes tend not to be moved by relatively lightly moving air, whereas water droplets of smaller size tend to be susceptible to being moved by lightly moving air.

For example, in some implementations where having the water droplets move within the drum in the presence of relatively lightly moving air, these water droplets may have sizes of 200 microns or smaller (e.g., 180 microns or smaller in one implementation). Water droplet size can be controlled by the air pressure of air supplied to the atomizer, the aperture size of the atomizer, the vibration rate of a vibrating membrane. The nozzle can have a single aperture or multiple apertures (such as a shower head). Water fed to the atomizer is pressured such that the water exiting the atomizer into the drum is in the form of water droplets (liquid water in droplet form) and generally not steam (individual water molecules sometimes also referred to as water vapor or the gaseous phase of water).

The use of steam in treating jeans and other apparel tends to turn the jeans grey and flattens the color of the jeans, which tends to be an undesirable finish of consumers. To provide that the mist remains in water droplet form and not steam, the mist may be introduced at a temperature below the temperature at which the water droplets would turn to steam, such as below 100 degrees Celsius. In some implementations, to provide that the water droplets do not turn to steam, the temperature in the drum is at ambient temperature (e.g., 20 to 30 degrees Celsius).

The use of temperatures in the drum below the temperature at which the water droplets in the mist would turn to steam also inhibits the ozone from breaking down before the ozone has a chance to bleach the jeans. Ozone generally breaks down more rapidly at higher temperatures, such as the temperature at which the water droplets turn to stream. The use of ambient temperature, or temperature less or much less than 100 degrees, in the drum further provides for the stabilization of the ozone.

In one implementations where the water droplets in the mist are about 180 microns (in some implementations about 200 microns or less), the water droplets tend to be swirled by air moving in the drum. The swirling water droplets in combination with the ozone in the drum tend to swirl around the unprocessed jeans to create a shadow effect in the finished jeans. The shadow effect in jeans is one of the fashion finishes of jeans desired by consumers.

FIG. 6 shows a relatively small portion of finished jeans or other finished apparel that have been processed via finish process 101 and finishing system 110. The circular elements in the jeans portion represent portions of the jeans where water droplets from the mist have landed on the jeans and the ozone has bleached the dye in the jeans. The portion of the jeans around the bleached portions include dye that is not bleached or has been bleached to a lesser amount than the portions where the water droplets have landed. The bleached portions and unbleached portions (or relatively lightly bleached portions) form a washed finish, such as a stonewashed finish in the jeans. The stonewashed finish is one of the fashion finished desired by consumers. I Turning now to the rotation of the drum, during finishing, the rotation rate of the drum can be set so that the jeans or other apparel fall from a top portion of the drum to a bottom portion of the drum. For example, the revolutions per minute (RPMs) of the drum can be set so that the jeans fall in the drum at about minus 30 degrees (i.e., from before vertical at the top of the drum) to about plus 60 degrees (i.e., from after vertical at the top of the drum). The rotation of the drum can alternate between clockwise, counterclockwise, in any sequence, to achieve the desired effect.

The angle of fall of the jeans at minus 30 degrees refers to the jeans falling prior to reaching vertical in their rotation, and the angle of fall of the jeans at plus 60 degrees refers to the jeans falling after the jeans pass vertical in their rotation. In some implementations, the RPMs of the drum is set at 20-35 RPMs (e.g., about 25, 26, 27, 28, 29, or 33 RPMs) so that the jeans fall at about minus 30 degrees to about plus 60 degrees. The foregoing described angles of fall of jeans and the RPMs used to achieve these angles of fall are described for purposes of example. Other RPMs can be used to achieve other angles of fall to achieve a variety of finishes.

Further, based on the diameter of the drum, the RPMs can alternatively be set to achieve angles of fall between minus 30 degrees and plus 60 degrees. According to an alternative implementation, during finishing, jeans are tumbled in the drum so that the jeans tumble substantially along the bottom of the drum. The RPMs of the drum can be set at about 18-28 RPMs or lower (e.g., about 19, 20, 21, 22, 23, 24, 25, or 26 RPMs) so that the jeans tumble substantially along the bottom of the drum. The rotation rate may be set by control system 220 or the like.

Drum 200 may have a variety of sizes for holding a single pair of jeans or a number of jeans (e.g., 2, 5, 10, 20, 100, or more). For example, the drum may have a diameter of about 1 foot to about 30 feet and have a width of about 1 foot to about 100 feet.

Figure 7:
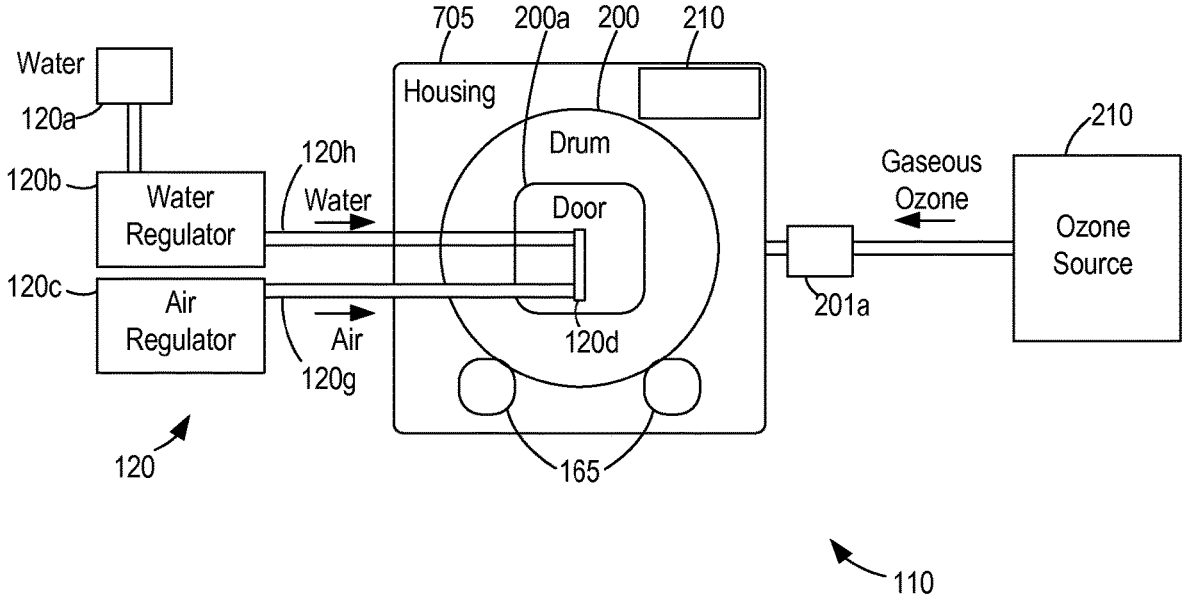
FIG. 7 is a block diagram of a specific implementation of a finishing system.

FIG. 7 is a block diagram of a specific implementation of finishing system 110. Finishing system 110 includes a housing 705, ozone source 210, an ozone delivery system 210*a* for the ozone, and a water delivery system 720.

Housing 705 may include drum 200 and at least one door 200*a* that is configured to provide access to an interior portion of the drum. The door may be positioned at a first end of the drum. In some implementations, a second door may be positioned at a second end (opposite from the first end) of the drum. The doors seal the drum to inhibit mist and ozone from escaping from the drum during finishing of jeans or other apparel. The drum is configured to hold one or more jeans for finishing. The drum may be configured to rotate at a variety of rotation rates (e.g., revolutions per minute (RPMs)) as described above.

Ozone source 210 may include an ozone delivery system 210*a* that delivers ozone to the drum. Ozone source 210 may also include an ozone generator that is configured to generate ozone from water, ambient oxygen, or other oxygen sources, such as an oxygen tank. Ozone source 2100 might alternatively include a reservoir (e.g., a tank) that holds ozone (e.g., liquid ozone) for delivery to ozone delivery system 210*a* and drum 200.

Ozone delivery system 210*a* may be connected to housing 705 and may be configured to deliver gaseous ozone from the ozone source to the drum. Ozone delivery system 210*a* may be a controllable system that may be controlled to deliver metered amounts of gaseous ozone to the drum. For example, the ozone delivery system may be controlled to deliver 5 grams, 10 grams, 15 grams, 20 grams, 25 grams, 30 grams, or more of gaseous ozone to the drum. The ozone delivery system may be configured to be manually controlled by a user or may be configured to be controlled by control system 210 to deliver various amounts of metered ozone to the drum.

Water delivery system 720 may be connected to housing 705 and may be configured to deliver water to drum 200. More specifically, the water delivery system may be configured to generate a water and air mist as described above and deliver the mist to the interior of the drum.

Water delivery system 720 may include a holding tank or other water source 720*a*. Water delivery system 720 may include a water regulator 720*b* that is configured to deliver a metered amount of water from the watery delivery system to the drum in the form of mist. The water delivery system may also include an air regulator 70*c* that is configured to deliver a metered amount of air for the mist.

Water delivery system 720 may include one more sources that are configured to provide one or more additional substances that can be mixed with the water and delivered in the mist. At least one source is configured to provide a metered amount of hydrogen peroxide. Watery delivery system 720 may be configured to deliver ratios of water and air for the mist.

Figure 8:
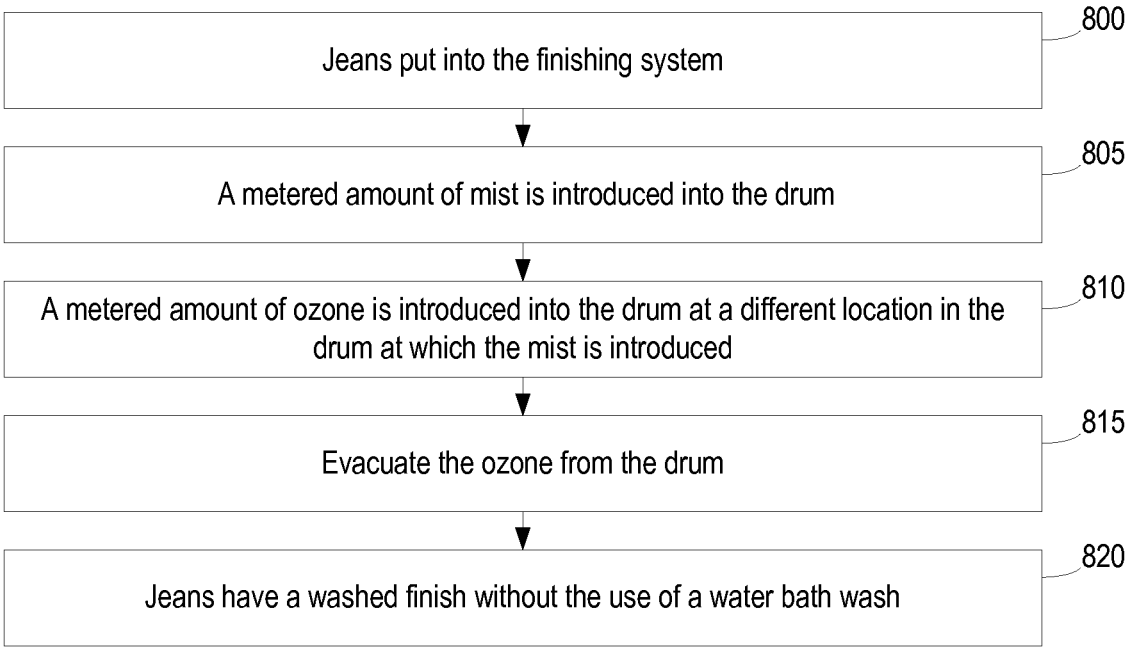
FIG. 8 is a flow diagram for finishing jeans or other apparel.

FIG. 8 is a flow diagram of a method for finishing jeans or other apparel using finishing system 110 according to one implementation of the present invention. The flow diagram represents one example implementation. Steps may be added to, removed from, or combined in the high-level flow diagram without deviating from the scope of the implementation.

In step 800, jeans or other apparel are put into finishing system 110 via the door. The mist is then delivered into the drum at ambient temperature (e.g., 20-30 degrees Celsius) or at least below a temperature (e.g., 100 degrees Celsius at sea level) at which the water droplets in the mist would turn to steam, step 805. The water and air in the mist may be metered so that a predetermined amount of water, air, or both are supplied in the mist. For example, the amount of water in the mist may range from 100 grams to about 10,000 grams (e.g., about 600, 750, 850, 875, 900, 950, 1000, 1050, 1200, or 3000 grams according to specific implementations). The flow rate of the mist may also be controlled so that a desired flow rate of the mist is delivered to drum 200.

The size of the water droplets in the mist may be controlled by a variety of devices and techniques, such as by appropriately setting the pressure of the air (e.g., 0-50 pounds per square inch) pushing the water through atomizer 250. Drum 200 may be rotated while the mist is delivered into the drum so that the jeans inside the drum are substantially evenly coated with the mist. Alternatively, the drum may be stationary (i.e., not rotating) while the mist is being delivered. Rotating the drum during the delivery of the mist and leaving the drum stationary during the delivery of the mist may provide different finishes. For example, rotating the drum during delivery of the mist may provide jeans with a stonewashed finish. Leaving the drum substantially stationary while the mist is delivered may provide jeans with an acid washed finish.

At 810, ozone is delivered into the drum. The ozone may be delivered while the drum is rotating or stationary. The ozone may be delivered after the mist is delivered into the drum at step 805, or while the mist is delivered. The ozone may be metered so that a predetermined amount of ozone is delivered into the drum 200. After the ozone is delivered into the drum, the drum may be substantially continuously rotated, not rotated, or the rotation may be stopped and restated at various time points.

Thereafter, the ozone may be evacuated from the drum, step 815, and the jeans treated in the finishing system have a washed finish, such as a stonewashed finish, step 820 without the use of a water bath wash. One or more steps of the foregoing described process steps may be repeated. For example, additional mist may be delivered into drum 200 after the ozone is delivered, or additional ozone may be delivered after ozone is initially delivered into the drum. In some implementations, the contents of the drum (mist and ozone) may be evacuated from the drum during finishing to maintain a desired pressure in the drum. For example, gases in the drum may be evacuated so that unacceptably high pressure does not build as the chemical bleaching process occurs. A check valve can be attached to the drum so that gasses can be evacuated if pressure rises to a predetermined level.

In some implementations, jeans or other apparel are pretreated prior to the being finished as described above. For example, prior to being finished by finishing system 110, the jeans may be abraded (e.g., sanded, stonewashed with pumice stones, or the like), rinsed in one or more water rinses, or a combination of these. Abrasions steps and rinsing steps may be also repeated to achieve various finishes.

In a specific implementation, before being finished by finishing system 110, about 1-5 kilograms of jeans, are abraded with stones (e.g., pumice stones) for 5-15 minutes (e.g., 8, 9, 10, 11, 12, or 13 minutes) in 28-35 Celsius water bath using 12-20 gallons of water (e.g., 13-14, 15-16, or 17-18 gallons of water). Thereafter, the jeans are be rinsed in a water bath. For example, the jeans may be rinsed twice for approximately a few minutes (e.g., 1-5 minutes) in 28-35 degree Celsius water bath using 12-20 gallons of water (e.g., 13-14, 15-16, or 17-18 gallons of water). Thereafter, the jeans may be treated in finishing system 110 as described above. The water amounts, the water temperatures, the temporal durations of the pretreatment washes, and the amount (kilograms) of jeans described above may be varied to achieve different finishes.

According to another finishing process, jeans or other apparel are rinsed a number of times in a water rinse prior to be finished by finishing system 110. For example, the pretreatment may include rinsing 1-5 kilograms of jeans for about 5-15 minutes (e.g., 8, 9, 10, 11, 12, or 13 minutes) in 28-35 degree Celsius water bath using 12-20 gallons of water (e.g., 13-14, 15-16, or 17-18 gallons of water). Thereafter, the jeans may be rinsed twice for a few minutes (e.g., 1-5 minutes) in 28-35 degree Celsius water bath using 12-20 gallons of water (e.g., 13-14, 15-16, or 17-18 gallons of water). Thereafter, the jeans may be treated in treatment system 110 as described above. The water amounts, the water temperatures, the temporal durations of the pretreatment washes, and the amount (kilograms) of jeans described above may be varied to achieve different finishes.

In some implementations, stones (e.g., a relatively small amount of pumice) are added to the drum, for example, at the time the jeans are placed in the drum. The stones may abrade the jeans while the drum is rotated. The abrasion can change an amount that the ozone bleaches the jeans. In still other implementations various substances are be delivered into the drum with the mist, such as enzymes, hydrogen peroxide, or the like.

Postprocessing may be performed on the jeans. For example, the jeans may be rinsed in a water bath either in the drum or in another rinsing machine. The amount of water used in the rinse and the duration of the rinse may be based on the amount of ozone used by the finishing system. Fabric softener might be used in the postprocessing rinse to achieve a predetermine aesthetic, or a fabric softener may be sprayed on the jeans after the postprocess rinse, such as before or during a drying process.

Figure 9:
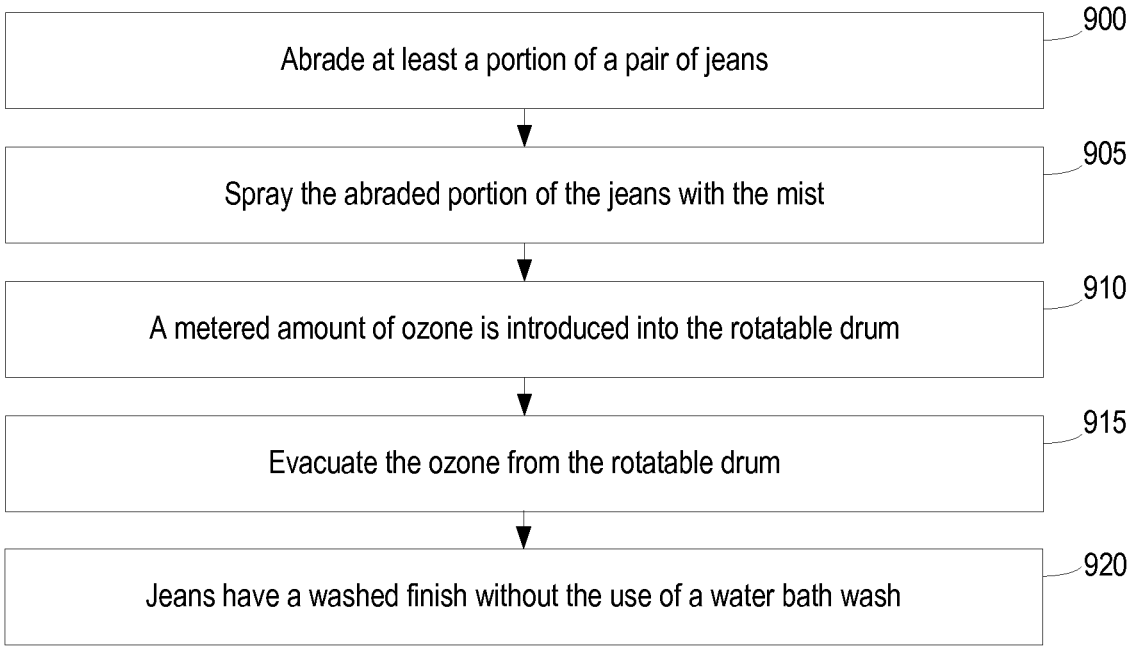
FIG. 9 is another flow diagram for finishing jeans or other apparel.

FIG. 9 is a flow diagram of a method for finishing jeans or other apparel using the finishing system according to one implementation of the present invention. The flow diagram is an example of an implementation. Steps may be added to, removed from, or combined in the flow diagram without deviating from the scope of the implementation.

In step 900, jeans are abraded on one or more portions. The jeans may be abraded by sanding, sand blasting, stone abrasion, laser light exposure, chemical abrasion, or other processes. The described abrading processes may be machine controlled, computer controlled, hand applied, or any combination of these processes.

In some implementations, at least one template is placed on the jeans prior to being abraded where one or more portions of the jeans are exposed through one or more cutouts in the template. The template provides that the exposed portions of the jeans are abraded in step 900. Other portions of the jeans covered by the template remain substantially unabraded. For example, in a laser abrasion process, laser light from a laser may abrade portions of the jeans exposed by a template, whereas portions of the jeans covered by the template are not abraded by the laser light.

In step 905, the jeans or a portion of the jeans, such as the abraded portion, are sprayed with the mist. The mist may be applied to the jeans while the jeans are outside of finishing system 110. In implementations where the abraded portions of the jeans are sprayed with mist but other portions of the jeans are not sprayed with mist, a template (such as the template used for abrading the jeans) may be placed over the jeans to expose the abraded portions but not expose the un-abraded portions. Thereafter, the jeans are placed into drum 200 for further finishing.

Additional mist or ozone is delivered into the drum at ambient temperature (e.g., 20-30 degrees Celsius) or at least below a temperature (e.g., 100 degrees Celsius) at which the water droplets in the mist would turn to steam, step 910. The drum may be rotating or stationary when the mist, the ozone, or both are delivered. After the mist, the ozone, or both are delivered, the drum may be rotated, the rotation may be started and stopped, or the drum may stationary. After the desired finish effect is achieved, the ozone may be vented from the drum, step 915, and the jeans may be removed. In some implementations, the jeans may be post-processed as described above. The jeans treated in the finishing system have a washed finish, such as a stonewashed finish, step 920 without the use of a water bath wash.

Turning again to memory 420, the memory may store computer code that is executable by processor 415 for a finishing process 101 and specifically for controlling drum 200, atomizer 205, ozone source 210, or a combination of these devices. The memory may also be configured to store information for a variety of parameters for finishing processes 101. For example, the memory can store rotation information for various rotations rates of the drum, store timing information for the cycle lengths (i.e., temporal lengths) for various finishing processes. For example, the cycle lengths may be 5 minutes, 10 minutes, 15 minutes, 20 minutes, 25 minutes, 30 minutes, 35 minutes, 40 minutes, or the like. The memory can also store timing information for start times, stop times, and restart times for the rotation of drum 200 that occur during various finishing processes.

For example, the memory may store timing information for rotating the drum while mist is introduced into the drum, stopping the rotation of the drum one minute or the like after the mist is sprayed or after ozone is delivered to the drum, and restarting the rotation after the rotation was stopped. It is noted that the foregoing stop times and restart times are provided by way of example, and that various other stop times and restart times may be used by finishing system to effect various finishes. The memory can also store concentration information for air, water, ozone, or a combination of these that is to be delivered to the drum. The memory can also store timing information for various time points for when mist and ozone are to be delivered to the drum. The memory can also store timing information for pulse rates for pulsing the delivery of mist, ozone, or both to the drum. The pulsed delivery of mist, ozone, or both to the drum can achieve various finishes, and pulsed delivery is used in some implementations to achieve these finishes.

In various implementations, the memory may store information for one or more of the above parameters (e.g., rotation rate, cycle length, stop times, restart times, amounts and concentrations of air, water, ozone, and the like) as sets of finishing information in a finishing information database. A set of finishing information stored in the memory may be user selectable, for example, via keyboard 405 our other user input device, such as display 400 if the display is a touch display. Each set of finishing information stored in the memory may be associated with a specific finish (e.g., a variety of acid washed appearances). The memory may be user programmable so that the user can edit the above parameters to effect new and different finishes of finished jeans or other finished apparel.

Display 400 is currently described in further detail. The display may be connected to processor 415 via bus 450 and may be controlled by the processor. The display may be one or more of a variety of display types, such as a light emitting diode display, a liquid crystal display, various types of touch screens, or the like. According to an implementation where the display is a touch screen, the display is configured to operate as a user interface device from which various sets of finish information may be selected for finish process 101.

Display 400 may be configured to display a variety of information regarding various finishing processes 101, such as time points in finishing processes, amounts and concentrations of air, water, ozone, and the like applied to jeans being finished. Display 400 may also display user selectable parameters (e.g., for cycle lengths, stop times, restart times, amounts, concentrations, and the like) for finishing process 101. Display 400 may also display user selectable options for the sets of finishing information so that the sets of finishing information may be customized. Display 400 may also be configured to display finish information for various aspects of a finishing process as the finishing process is being run by finishing system 110. For example, the display may display the length of time a finishing process has run, and the time remaining until the end of the finishing process. Display 400 may also display other parameters, such as the parameters in a set of finishing information for a finishing process being run.

Among other benefits, finishing system 110 allows for the reduction or elimination of the use of traditional chemical agents for finish treating jeans and other apparel to achieve the effect of highlighted wear patterns achieved by chemical washing. Finishing system 110 also allows for the reduction or elimination of the use pumice stones and enzymes to achieve abrasions on jeans and to achieve finishing effects, such as stonewashing. Finishing system 110 also allows for finishing jeans and other apparel in batch loads.

Finishing system 110 also preserves a true indigo color shade and other authentic wash effects, and avoids graying effects and a generally flat appearance caused by other finishing processes. For example, the introduction of the mist and the ozone independently (e.g., from distinct sources), sequentially, at the same time, or any combination of these avoids graying effects and a generally flat appearance of the color (e.g., indigo colors). Also, the delivery of the mist and the ozone independently, sequentially, at the same time, or any combination of these provides repeatable finishes and preserves the true indigo color shade and other authentic wash effects. Delivery of the mist mixed with ozone from a single delivery nozzle into a finishing chamber has been determined to gray and flatten colors, which tends to be less desirable to consumers.

Further, introducing water and air mist from separate inlets (such as first inlet and ozone from a second inlets) as compared with water and air mist and ozone introduced from a single inlet, avoids the potential for ozone to break down prior to delivery to the drum due to the ozone's half life in a wet environment. The use of first and second inlets allows for the use of more precisely known amounts of ozone in the present invention by avoiding the ozone being in an environment were the ozone can breakdown before introduction into the drum.

However, in some specific implementation, the system can be designed to use a single inlet for both water and air mist and ozone. For example, a common inlet can be used, but care is taken so constituents do not mixed or interfere with each other, such as thoroughly evacuating or cleaning an inlet before allowing a different constituent from passing through it.

This description of the invention has been presented for the purposes of illustration and description. It is not intended to be exhaustive or to limit the invention to the precise form described, and many modifications and variations are possible in light of the teaching above. The implementations were chosen and described in order to best explain the principles of the invention and its practical applications. This description will enable others skilled in the art to best utilize and practice the invention in various implementations and with various modifications as are suited to a particular use. The scope of the invention is defined by the following claims.

The invention claimed is:

1. A method comprising:

placing dry jeans or other apparel into a chamber;

spraying water droplets and air in the chamber, wherein first portions of the jeans absorb water from contacting the water droplets and second portions of the jeans absorb less water relative to the first portions;

injecting ozone gas into the chamber while the spraying water droplets and air is occurring;

rotating the jeans with first and second portions in the chamber with the water droplets and air and ozone gas, wherein the ozone gas reacts with the first portions resulting in a first bleaching effect and reacts with the second portions resulting in a second bleaching effect, and the second bleaching effect is less than the first bleaching effect; and due to the different first and second bleaching effects on the jeans, obtaining a stonewashed effect on a surface of the jeans or other apparel.

2. The method of claim 1 comprising:

before the placing dry jeans or other apparel into the chamber, spraying a localized abrasion region of the dry jeans with water.

3. The method of claim 1 wherein the water droplets and air sprayed into the chamber comprise a mist and do not include steam.

4. The method of claim 1 wherein the spraying water droplets and air in the chamber occurs at a temperature below which water droplets would turn to steam.

5. The method of claim 1 wherein the spraying water droplets and air in the chamber occurs at an ambient temperature.

6. The method of claim 1 wherein at least a portion of water droplets in the water droplets and air sprayed into the chamber have a size from about 200 microns to about 250 microns.

7. The method of claim 1 wherein the rotating chamber effects a swirling of the water droplets and ozone gas together.

8. The method of claim 7 wherein the swirling of the water droplets and ozone gas together results in a shadow effect on the surface of the jeans or other apparel.

9. A method comprising:

placing dry jeans or other apparel into a chamber;

spraying water droplets and air in the chamber with the dry jeans while the chamber is static, wherein while the jeans are static in the chamber, first portions of the jeans absorb water from contacting the water droplets and second portions of the jeans absorb less water relative to the first portions;

after turning off spraying of water droplets and air in the chamber, rotating the chamber with jeans comprising first and second portions;

after the chamber is rotating, injecting ozone gas into the chamber, wherein the ozone gas reacts with the first portions of the jeans resulting in a first bleaching effect and reacts with the second portions resulting in a second bleaching effect, and the second bleaching effect is less than the first bleaching effect; and due to the different first and second bleaching effects on the jeans, obtaining an acid washed effect on a surface of the jeans or other apparel.

10. The method of claim 9 comprising:

before the placing dry jeans or other apparel into the chamber, spraying a localized abrasion region of the dry jeans with water.

11. The method of claim 9 wherein the water droplets and air sprayed into the chamber comprise a mist and do not include steam.

12. The method of claim 9 wherein the spraying water droplets and air in the chamber occurs at a temperature below which water droplets would turn to steam.

13. The method of claim 9 wherein the spraying water droplets and air in the chamber occurs at an ambient temperature.

14. The method of claim 9 wherein at least a portion of water droplets in the water droplets and air sprayed into the chamber have a size from about 200 microns to about 250 microns.

15. A method comprising:

placing dry jeans or other apparel into a chamber;

spraying water droplets and air in the chamber with the dry jeans while the chamber is rotating, wherein while the jeans are being rotated in the chamber, first portions of the jeans absorb water from contacting the water droplets and second portions of the jeans absorb less water relative to the first portions;

after turning off spraying of water droplets and air in the chamber and the chamber continues rotating, injecting ozone gas into the chamber, wherein the ozone gas reacts with the first portions of the jeans resulting in a first bleaching effect and reacts with the second portions resulting in a second bleaching effect, and the second bleaching effect is less than the first bleaching effect; and due to the different first and second bleaching effects on the jeans, obtaining a stonewashed effect on a surface of the jeans or other apparel.

16. The method of claim 15 comprising:

before the placing dry jeans or other apparel into the chamber, spraying a localized abrasion region of the dry jeans with water.

17. The method of claim 15 wherein the water droplets and air sprayed into the chamber comprise a mist and do not include steam.

18. The method of claim 15 wherein the spraying water droplets and air in the chamber occurs at a temperature below which water droplets would turn to steam.

19. The method of claim 15 wherein the spraying water droplets and air in the chamber occurs at an ambient temperature.

20. The method of claim 15 wherein at least a portion of water droplets in the water droplets and air sprayed into the chamber have a size from about 200 microns to about 250 microns.

* * * * *